US005409410A

United States Patent [19]

Bohlin

[11] Patent Number: 5,409,410

[45] Date of Patent: Apr. 25, 1995

[54] HYDRAULIC STEERING ARRANGEMENT, IN PARTICULAR FOR BOATS

[75] Inventor: Stig Bohlin, Göteborg, Sweden

[73] Assignee: AB Volvo Penta, Gothenburg, Sweden

[21] Appl. No.: 78,292

[22] PCT Filed: Jan. 22, 1992

[86] PCT No.: PCT/SE92/00040

§ 371 Date: Jun. 21, 1993

§ 102(e) Date: Jun. 21, 1993

[87] PCT Pub. No.: WO92/12896

PCT Pub. Date: Aug. 6, 1992

[30] Foreign Application Priority Data

Jan. 23, 1991 [SE] Sweden ..... 9100204

[51] Int. Cl.[6] ..... B63H 25/42

[52] U.S. Cl. ..... 440/61; 60/385; 114/150

[58] Field of Search ..... 440/61; 114/150; 60/385

[56] References Cited

U.S. PATENT DOCUMENTS 4,632,049 12/1986 Hall et al. ..... 440/61

4,892,494 1/1990 Ferguson ..... 440/61

5,213,527 5/1993 Fetchko ..... 114/150 X

OTHER PUBLICATIONS

"Installation Instructions Hydraulic Steering for Servo cylinders Kit No. 1140585-9" by Volvo Penta.

*Primary Examiner*—Sherman Basinger

*Attorney, Agent, or Firm*—Young & Thompson

[57] ABSTRACT

Hydraulic steering arrangement, comprising a first hydraulic pump connected to a steering wheel, a piston cylinder device hydraulically coupled to the first hydraulic pump and arranged for connection to a steering mechanism, a second hydraulic pump and a second piston cylinder device hydraulically coupled via a servo valve to the second hydraulic pump. The second piston cylinder device is connected to the steering mechanism. The servo valve has an actuating element which is affected by the first piston cylinder device to activate the second piston cylinder device, and which comprises a tubular element limitedly displaceable relative to the servo valve housing. A guide (20) is axially displaceably mounted in the tubular element (13) and is joined to the piston cylinder devices (5, 17). The guide is provided, at a portion (21) extending out of the tubular element, with a stop (22) which can be fixed at different axial positions on the extending portion to limit the maximum extent of stroke of the piston cylinder devices in one direction.

3 Claims, 1 Drawing Sheet

HYDRAULIC STEERING ARRANGEMENT, IN PARTICULAR FOR BOATS

The present invention relates to a hydraulic steering arrangement comprising a first hydraulic pump connected to a steering wheel, a piston cylinder device hydraulically coupled to the first hydraulic pump and arranged for connection to a steering mechanism, a second hydraulic pump and a second piston cylinder device hydraulically coupled via a servo valve to the second hydraulic pump, said second piston cylinder device being arranged to be connected to the steering mechanism, said servo valve having an actuating element which is affected by the first piston cylinder device to activate the second piston cylinder device and which comprises a tubular element limitedly displaceable relative to the servo valve housing.

BACKGROUND OF THE INVENTION

In a known steering arrangement of this type especially designed for boats, the piston rod of the first hydraulic cylinder is displaceably mounted in the tubular actuating element of the servo valve, while its cylinder has one end fixed to one end of the actuating element. The distal end of the piston rod together with the piston rod of the other piston cylinder device is connected to a steering arm on a rudder shaft or a steerable outboard drive unit. In such a steering device, the maximum piston rod extension is determined by the length of stroke of the piston in the first cylinder and in order to adapt the maximum extension of the piston rod to the required maximum deflection of the steering arm, a stop sleeve at the distal end of the cylinder is used or alternatively axially spaced mounting holes in the distal end of the piston rod. By means of the stop sleeve or the choice of mounting holes, the length of travel can be varied in steps and in this manner be adapted to the steering arm pivot movement required for the installation in question.

SUMMARY OF THE INVENTION

The purpose of the present invention is to provide a steering arrangement of the type described by way of introduction in which the maximum steering arm swing can be simply varied with the steering arrangement mounted in place to thus make it possible for the customer to make the required adjustment. Said arrangement can also be made more compact and less bulky athwartships.

This is achieved according to the invention by virtue of the fact that a guide means is axially displaceably mounted in the tubular element and is joined to the piston cylinder devices and that the guide means is provided, at a portion extending out of the tubular element, with a stop which can be fixed at different axial positions on the extending portion to limit the maximum extent of stroke of the piston cylinder devices in one direction.

The stop can be formed of a nut on a threaded portion of the guide rod, which makes possible, in a simple manner, continuous adjustment of the maximum extension of the piston rod. The arrangement makes possible placement of piston cylinder devices side by side, which reduces the total length of the steering arrangement and thus the space requirement athwartships.

BRIEF DESCRIPTION OF THE DRAWINGS

The invention will be described in more detail with reference to an example shown in the accompanying drawings, where.

DETAILED DESCRIPTION OF THE INVENTION

Figure 1:
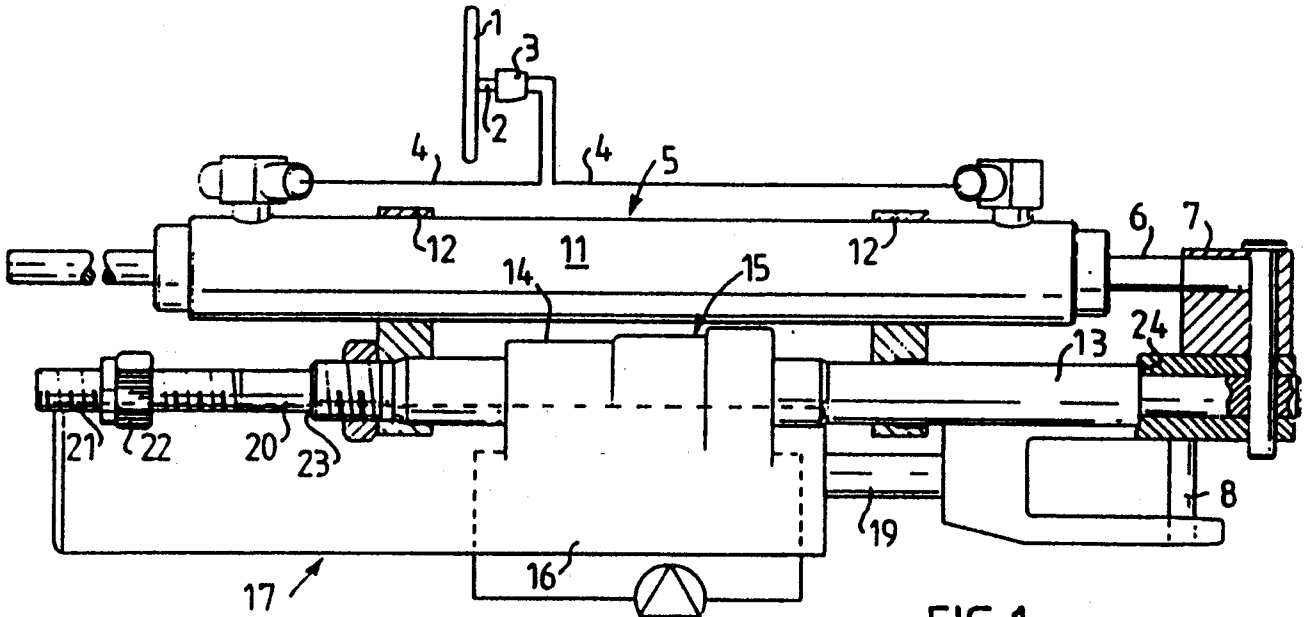
FIG. 1 shows a partially sectioned sideview of a preferred embodiment of a steering arrangement according to the invention.
Figure 2:
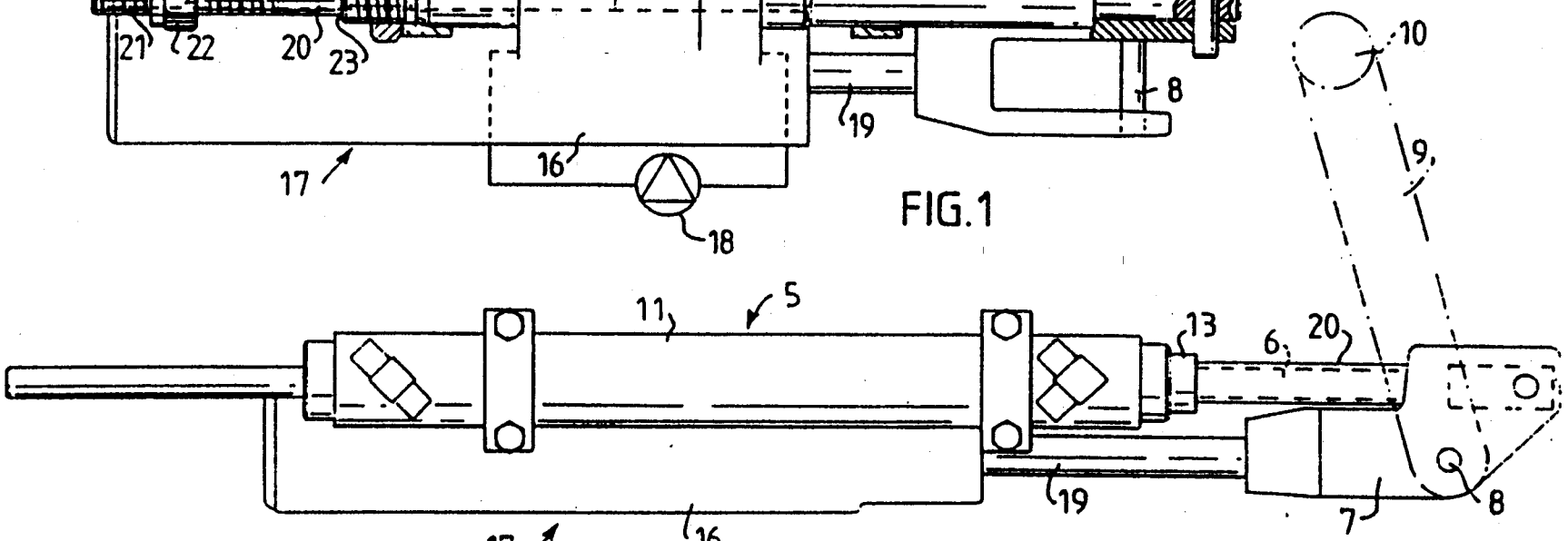
FIG. 2 is a view from above of the device in FIG. 1.

In FIG. 1, 1 designates a boat steering wheel, which is mounted on a shaft 2 which constitutes the driving shaft of a reversible hydraulic pump 3. The pump 3 is connected via hydraulic lines 4 to the cylinder chambers of a double-acting hydraulic piston cylinder device 5, the piston rod 6 of which is fixed to a connecting piece 7, which is coupled via a pivot pin 8 to a steering arm 9 on a rudder shaft 10 or the steering shaft of an outboard drive unit. As the steering wheel is turned in one direction or the other, oil is pumped to one or the other cylinder chamber at the same time as the opposite cylinder chamber is drained, and this extends or retracts the piston rod 6 and causes a corresponding swing/deflection of the steering arm 9.

The cylinder 11 of the piston cylinder device 5 is fixed via a pair of clamps 12 to a valve tube 13 which extends through a valve housing 14 of a servo valve with the general designation 15. The valve housing 14 is made in one piece with the hydraulic cylinder 16 of a second double-acting piston cylinder device 17 and it regulates, by the action of a valve slide (not shown) cooperating with the valve tube 13, the supply of hydraulic fluid to one or the other cylinder chamber in the cylinder 16, from a motor-driven hydraulic pump 18. The servo valve 15 with the valve tube 13 and the piston cylinder device 17 form a unit which can be of a known type such as that marketed by Showa Manufacturing Company Ltd and which thus does not need to be described in more detail here.

The piston rod 19 of the piston cylinder device 17 and a guide rod 20 are fixed to the connecting piece 7 joined to the piston rod 6. The guide rod 20 extends through the valve tube 13 and has a threaded portion 21 onto which a stop nut 22 is screwed. As the steering wheel 1 is turned, so that oil is pumped into the lefthand cylinder chamber of the cylinder 11, the piston rod 6 is extended, i.e. displaced to the right in the figures. The reactive forces on the cylinder 11 cause the valve tube 13 to be moved to the left relative to the valve housing 14, and this results in the servo valve 15 opening and conducting oil into the lefthand cylinder chamber of the cylinder 16, thus causing a displacement of the piston rod 19 to the right. As long as the steering wheel is turned so that oil is pumped into the cylinder 11, the reactive force on the valve tube will cause oil to be supplied to the cylinder 16 serving as a servo unit. When there is no turning of the steering wheel, the servo valve 15 closes due to feedback between the two piston cylinder devices.

In the process described, the guide rod 20 follows the movements of the two piston rods 6 and 19, which means that the nut 22, after a certain length of stroke of the piston rods, will strike the end surface 23 of the valve tube 13, thus limiting the stroke. The maximum length of stroke can thus easily be set by turning the nut 22 to a suitable position on the threaded portion of the guide rod 20. The maximum extension and thus the maximum steering deflection in the opposite direction is determined by the opposite end surface 24 of the valve tube 14 and the opposing surface of the connecting piece 7, and is thus affected by the axial placement of the cylinder 11 relative to the valve tube 14.

In addition to being able to limit the steering deflection in a simple manner by means of the described arrangement, there is provided a more compact configuration of the steering arrangement as compared to the conventional arrangement, in which the piston rod 6 on the cylinder 11 would extend through the valve tube 14, since this would mean that the righthand end of the cylinder 11 must be fixed to the lefthand end of the valve tube.

I claim:

1. Hydraulic steering arrangement, comprising a first hydraulic pump connected to a steering wheel, a piston cylinder device hydraulically coupled to the first hydraulic pump and arranged for connection to a steering mechanism, a second hydraulic pump and a second piston cylinder device hydraulically coupled via a servo valve to the second hydraulic pump, said second piston cylinder device being arranged to be connected to the steering mechanism, said servo valve having an actuating element which is affected by the first piston cylinder device to activate the second piston cylinder device, and which comprises a tubular element limitedly displaceable relative to the servo valve housing, characterized in that a guide means (20) is axially displaceably mounted in the tubular element (13) and is joined to the piston cylinder devices (5,17) and that the guide means is provided, at a portion (21) extending out of the tubular element, with a stop (22) which can be fixed at different axial positions on the extending portion to limit the maximum extent of stroke of the piston cylinder devices in one direction.

2. Steering arrangement according to claim 1, characterized in that the housing (14) of the servo valve (15) is solidly joined to the cylinder (16) of the second piston cylinder device and the tubular element (13) is solidly joined to the cylinder (11) of the first piston cylinder device and that the stop is formed by an internally threaded element (22) screwed onto a threaded portion (21) of a guide rod (20).

3. Steering arrangement according to claim 2, characterized in that the piston cylinder devices (5,17) and the guide rod (20) are arranged side by side in parallel, that the respective piston rods (6,19) are joined to each other and to the guide rod at one end of the respective rods, and that the guide rod carries the stop at its opposite end.

* * * * *